US006857779B2

(12) United States Patent
Olin

(10) Patent No.: US 6,857,779 B2
(45) Date of Patent: Feb. 22, 2005

(54) FLEXIBLE BAG WITH RESEALABLE POUR SPOUT

(75) Inventor: Alan D. Olin, Menlo Park, CA (US)

(73) Assignee: Alan Olin, Menlo Park, CA (US)

( * ) Notice: Subject to any disclaimer, the term of this patent is extended or adjusted under 35 U.S.C. 154(b) by 0 days.

(21) Appl. No.: 10/367,801

(22) Filed: Feb. 19, 2003

(65) Prior Publication Data

US 2003/0123760 A1 Jul. 3, 2003

Related U.S. Application Data

(60) Continuation of application No. 09/804,526, filed on Mar. 10, 2001, now abandoned, which is a division of application No. 09/339,702, filed on Jun. 24, 1999, now Pat. No. 6,206,571.

(51) Int. Cl.[7] ..... B65D 33/16

(52) U.S. Cl. ..... 383/204; 383/66; 383/104; 383/120; 383/906

(58) Field of Search ..... 383/66, 104, 120, 383/906, 907, 204

(56) References Cited

U.S. PATENT DOCUMENTS

| | | | | | |
|---|---|---|---|---|---|
| 432,308 | A | | 7/1890 | Guilbert | |
| 2,020,804 | A | | 11/1935 | Segal | |
| 2,188,039 | A | | 1/1940 | Farmer | |
| 2,536,529 | A | | 1/1951 | Bergstein | |
| 2,620,944 | A | | 12/1952 | Stahl | |
| 3,051,368 | A | | 8/1962 | Schneider et al. | |
| 3,077,295 | A | * | 2/1963 | Whiteford | 383/94 |
| 3,143,277 | A | | 8/1964 | LaFleur | |
| 3,367,380 | A | * | 2/1968 | Dickey | 383/104 |
| 3,387,701 | A | * | 6/1968 | Schneider et al. | 206/527 |
| 3,417,675 | A | * | 12/1968 | Ausnit | 493/211 |
| 3,502,521 | A | | 3/1970 | Doyen et al. | |
| 3,504,841 | A | * | 4/1970 | Bramson | 383/6 |
| 3,520,471 | A | | 7/1970 | Faust | |
| 3,640,381 | A | | 2/1972 | Kanada et al. | |
| 3,815,810 | A | | 6/1974 | Wellman | |
| 4,027,819 | A | | 6/1977 | Herrera-Gutierrez | |
| 4,171,755 | A | | 10/1979 | Carlisle | |
| 4,332,344 | A | | 6/1982 | Strodthoff | |
| 4,454,979 | A | * | 6/1984 | Ikeda et al. | 383/10 |

(List continued on next page.)

FOREIGN PATENT DOCUMENTS

| | | | | |
|---|---|---|---|---|
| FR | 1359333 | * | 3/1964 | 383/907 |
| JP | 0240650 | * | 10/1991 | 383/66 |
| JP | 0240651 | * | 10/1991 | 383/66 |

*Primary Examiner*—Jes F. Pascua
(74) *Attorney, Agent, or Firm*—Beyer Weaver & Thomas, LLP

(57) ABSTRACT

A four corner bag constructed of flexible thermoplastic sheet or film material having overlying front and rear wall panels and a bottom sealed end. The upper portion of the bag includes a first closure region terminating in a top sealed end, a second closure region disposed inwardly of the top sealed end, and a perforated seal or tear strip extending across the width of the bag and located between the first and second closure regions. The second closure region includes an inner heat seal which extends approximately halfway across the width of the bag and a reclosable fastener which extends the remaining distance across the bag. In one embodiment, the inner heat seal is oriented transversely across the bag while the reclosable fastener is upwardly angled so that it forms a natural pour spout during use. In other embodiments, the reclosable fastener is transversely oriented while the inner heat seal is angled. In still other embodiments, the reclosable fastener is vertically or longitudinally oriented and disposed adjacent a side edge at an upper corner region of the bag. In all embodiments containing a reclosable fastener, the tear strip is removed to access the reclosable fastener.

16 Claims, 9 Drawing Sheets

U.S. PATENT DOCUMENTS 4,759,642 A 7/1988 Van Erden et al.
4,787,755 A 11/1988 Branson
4,946,289 A 8/1990 Bolling et al.
4,953,708 A 9/1990 Beer et al.
5,007,744 A 4/1991 Scarberry et al.
5,060,803 A 10/1991 Beer et al.
5,080,253 A 1/1992 Zieke
5,104,235 A * 4/1992 Bronstrup et al. ..... 383/10
RE34,347 E 8/1993 VanErden et al.
5,525,363 A 6/1996 Herber et al.
5,593,229 A 1/1997 Warr
5,609,420 A 3/1997 Palmisano
5,611,626 A 3/1997 Warr
5,687,848 A * 11/1997 Scholz et al. ..... 206/438
5,716,473 A * 2/1998 Gordon et al. ..... 156/200
5,941,643 A * 8/1999 Linkiewicz ..... 383/210
6,007,246 A * 12/1999 Kinigakis et al. ..... 383/204
6,164,826 A * 12/2000 Petkovsek ..... 383/210.1
6,206,571 B1 * 3/2001 Olin ..... 383/204
6,409,386 B1 * 6/2002 Trani et al. ..... 383/120

* cited by examiner

FLEXIBLE BAG WITH RESEALABLE POUR SPOUT

This applications is a Continuation of the application having the Ser. No. 09/804,526 filed Mar. 10, 2001, now abandoned which is a Divisional Application of the then pending application having Ser. No. 09/339,702 filed Jun. 24, 1999, and has issued as U.S. Pat. No. 6,206,571.

TECHNICAL FIELD

The present invention relates generally to packaging for packaging pourable contents such as breakfast cereal, snack food product and the like., and more particularly to a flexible cereal bag provided with a reclosable pour spout.

BACKGROUND OF THE INVENTION

Packaging of breakfast cereal is customarily effected by sealing the dry cereal product within a plastic bag and storing the filled bag within a suitably sized cardboard box or carton. A disadvantage with this type of packaging is that once the sealed bag is opened, it is difficult to reseal the bag in an airtight manner necessary to maintain freshness of the cereal product.

In order to close a conventional cereal bag after the sealed top end has been opened, the user will typically fold the opened end of the bag over onto it self one or more times. Closing the bag in this way is awkward. Oftentimes, the user will simply stuff the opened end of the bag down into the box without regard to properly sealing the opening. Once opened, the conventional cereal bag is never again airtight. In humid climates, in particular, exposure of the dry cereal product to air quickly compromises the freshness of the cereal product. Furthermore, as additional serving portions of the cereal product are emptied from the bag with each use, it becomes more difficult to effectively seal close the open end of the bag by rolling the bag within the depth of the box or carton.

Another problem with conventional cereal bags is that it is difficult to open the sealed top end of the bag without also ripping or tearing the side panel walls of the bag. An unevenly opened bag often has an overhanging portion that blocks or traps cereal during pouring. In the case where the bag is used as a liner within a box, the overhanging portion of the ripped open bag often also causes spillage of the cereal contents into the crevice space between the bag and the box as the box is returned to the upright position. A flexible bag formed with an easily openable reclosable pour spout that overcomes the above-noted problems of the prior art would be desirable.

Flexible plastic bags or cereal box liners having a reclosable fastener or zipper for packaging cereal are known from the prior art. Examples of prior art flexible plastic bags having a reclosable fastener are found in U.S. Pat. Nos. 4,759,642, 4,946,289, and 5,080,253. In each of the bags disclosed is these patent documents, the reclosable fastener extends transversely across the entire width of the bag. None of these patent documents disclose or teach a bag having a reclosable fastener or associated structure that is configured to form a natural pour spout when the zipper material is opened. Quaker Oats currently markets a cereal bag having a zipper-type reclosable fastener under the trademark ZIP PAK. Like the prior art noted above, the reclosable fastener of the ZIP PAK bag extends across the entire width of the bag. The ZIP PAK bags, like most cereal bags on the market these days, are mass produced from a single web of film material using conventional in-line vertical form, fill and seal (VFFS) packaging equipment. As a result of the VFFS production process, the overlying front and rear panel walls of the bag are joined together by a joining fin seal that runs the longitudinal length of the bag. In the ZIP PAK bags, in particular, the joining fin seal bisects the zipper-type reclosable fastener across the top of the bag. Thus, there is a tendency for the joining fin seal to obstruct zipper closure action as the user applies thumb and finger pressure in a sweeping motion across the length of the zipper-type reclosable fastener. This obstruction often results in the bag not being completely sealed. Difficulty in airtight resealing a bag with such "full width" zip closures is compounded in the case where the bag is also used as a box liner.

U.S. Pat. Nos. 4,953,708 and 5,060,803 disclose flexible bags that form pour spouts when opened. The bags in these patent documents lack any resealable structure for the pour spouts and they require the sides of the bag to be gussetted which increases the cost of manufacture.

U.S. Pat. No. 4,332,344 discloses a flexible package for enclosing liquid or granular products which includes a tubular plastic bag and a pleated reclosable pour spout that is appended to the side edge of the bag. A bag of this configuration is complex in design and would be extremely expensive and difficult to mass manufacture using conventional VFFS equipment.

U.S. Pat. No. 5,611,626 discloses a bag with a corner tear-away pour spout opening. This patent teaches to reseal the bag after each use by attaching a separate adhesive patch to cover the corner pour spout opening. A drawback with this resealing approach is that the glue on the adhesive patch tends to loose its effectiveness after repeated uses. Also, since the adhesive patch is separable from the bag, it may become lost through carelessness of the user, thereby leaving the user without a convenient means for resealing the bag.

Accordingly, a bag having a pour spout which includes integral structure or means for resealing the pour spout and which is also easily mass produced using conventional VFFS equipment would constitute a significant advance in the art.

SUMMARY OF THE INVENTION

It is therefore a general object of the present invention to provide a flexible bag (or box liner) for packaging pourable contents such as dry cereal or snack food product, and wherein the bag is formed with an integral reclosable pour spout that is easy to open, pour cereal from, seal, and close.

It is a further object of the present invention to provide a design for a plastic bag (or box liner) having a reclosable pour spout which is simple in construction, low in cost, and well suited for mass production using conventional VFFS techniques.

In accordance with a preferred embodiment, the invention comprises a four corner bag constructed of flexible thermoplastic sheet or film material having overlying front and rear wall panels and a sealed bottom end. The upper portion of the bag includes a first closure region terminating in a top sealed end, a second closure region disposed inwardly of the top sealed end, and a perforated seal or tear strip extending across the width of the bag and located between the first and second closure regions. The second closure region includes an inner heat seal which extends approximately halfway across the width of the bag and a reclosable fastener which extends the remaining distance across the bag. The inner heat seal is oriented transversely across the bag while the reclosable fastener is upwardly angled so that it forms a natural pour spout during use. The path of the tear strip across the bag width preferably closely parallels the layout of the inner heat seal and reclosable fastener in order to permit convenient access to the reclosable fastener upon removal of the tear strip.

In the case where the bag is to be received within a close fitting carton or box for use as a box liner, the length of the bag is designed to be longer than the depth of the box so that the upper bag portion containing the angled reclosable fastener extends above the opened box top for ease in opening and closing and unobstructed pouring through the naturally formed pour spout.

In accordance with an advantageous aspect of the invention, the partial zipper-type reclosable fastener, by extending across only a portion of the bag width, will require less of the costly reclosable zipper material as compared to the full width zipper fasteners of the prior art bags, thereby achieving a reduction in production costs.

According to another preferred embodiment, the partial zipper-type reclosable fastener is oriented at an upward or downward angle relative to the transversely oriented inner heat seal so as to form a natural pour spout upon opening of the tear strip.

According to another preferred embodiment, both the inner heat seal and partial zipper-type reclosable fastener are colinear and oriented along an upward angle to form a natural pour spout upon opening of the tear strip.

According to another preferred embodiment, both the inner heat seal and partial zipper-type reclosable fastener are colinear and are transversely oriented across the width of the bag adjacent the top sealed end.

According to another preferred embodiment, both the inner heat seal and partial zipper-type reclosable fastener are colinear and are transversely oriented across the width of the bag and the tear strip is oriented at an upward angle to form a natural pour spout upon opening.

According to another preferred embodiment, the partial zipper-type reclosable fastener is vertically oriented along an upper corner region of the bag so as to form a natural pour spout upon opening of the tear strip.

According to another preferred embodiment, a full width zipper-type reclosable fastener is used in place of the combination partial zip/inner heat seal and is oriented along an upward angle to form a natural pour spout upon opening of the tear strip.

According to another preferred embodiment, a transversely oriented full width zipper-type reclosable fastener is used in place of the combination partial zip/inner heat seal and the tear strip is oriented along an upward angle to form a natural pour spout upon opening of the tear strip.

According to still another preferred embodiment, the tear strip, zipper-type reclosable fastener and inner heat seal are eliminated from the bag and the sealed top end of the bag is oriented along an upward angle relative to the transverse or widthwise axis of the bag. Opening of the upwardly angled sealed top end results in a naturally formed pour spout.

In accordance with another advantageous aspect of the invention, one or more holes may be provided to the top sealed end of the bag of each of the preferred embodiments, the hole(s) being sized to receive hook structure of the type used for hanging and displaying the bag at a retail location.

Methods and apparatus which incorporate the features described above and which are effective to function as described above constitute specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

DETAILED DESCRIPTION OF THE PREFERRED EMBODIMENTS

Figure 1:
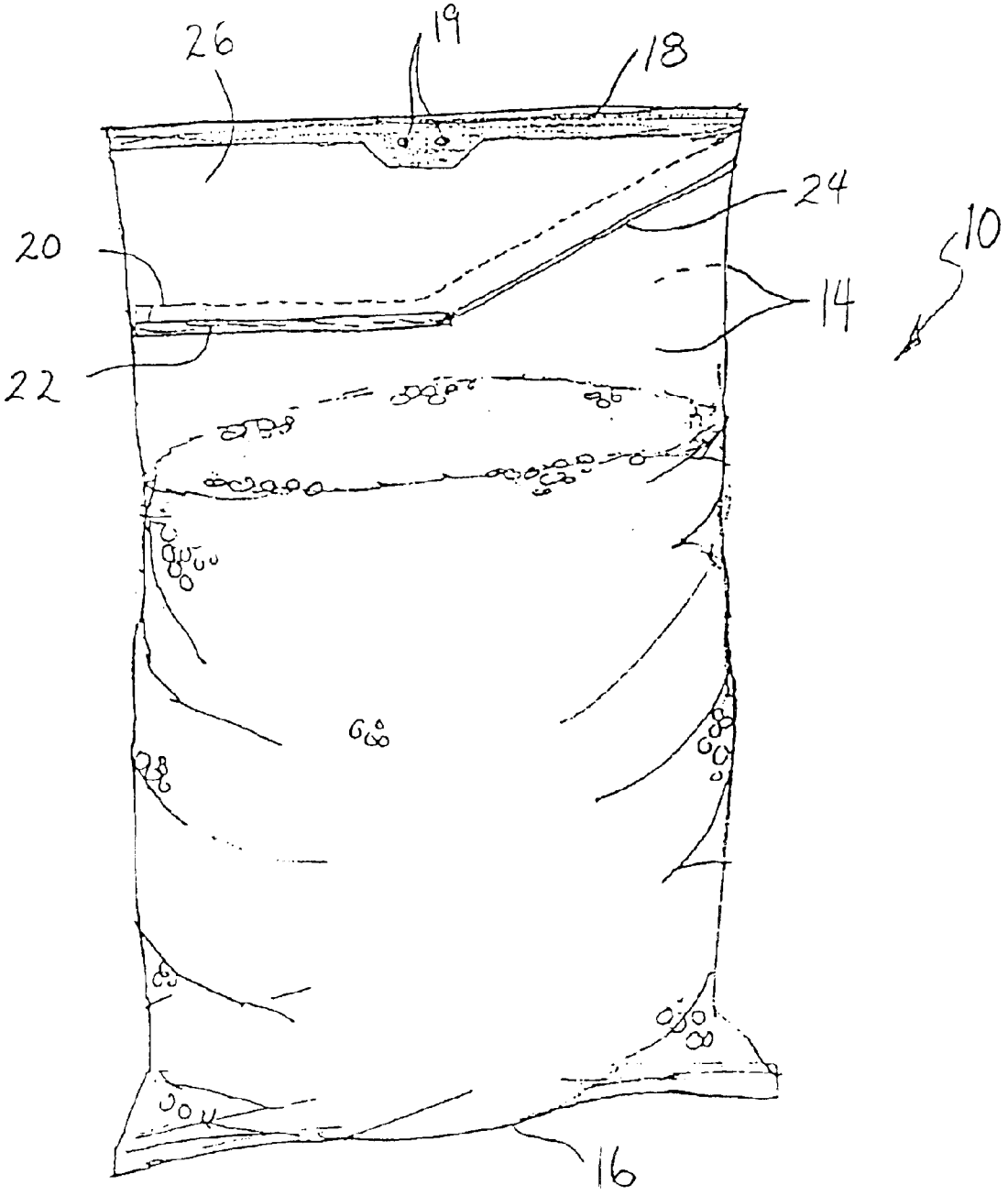
FIG. 1 is a generally schematic view of a flexible bag with resealable pour spout in accordance with a first embodiment of the present invention.
Figure 2:
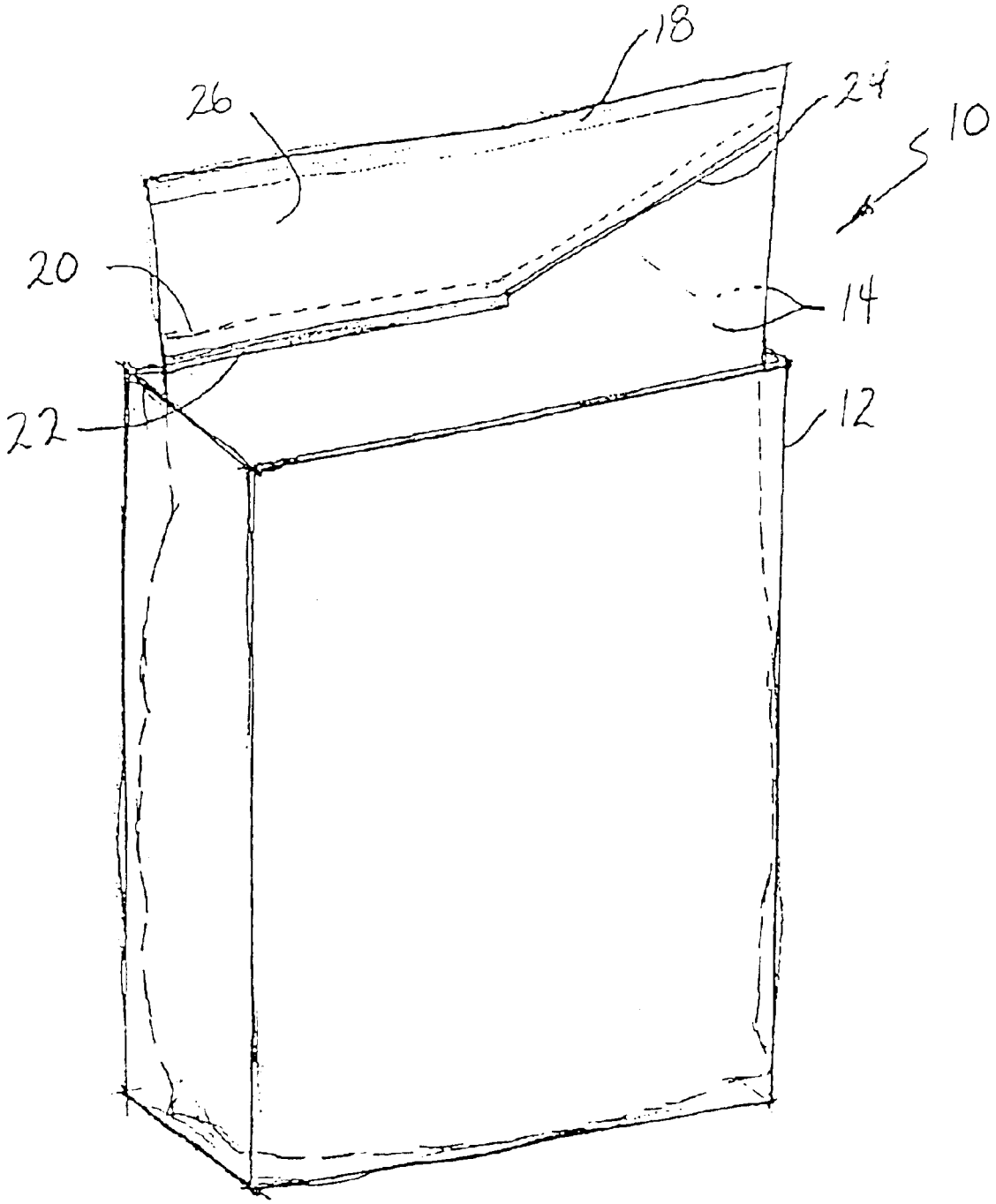
FIG. 2 is a generally schematic view of the bag of FIG. 1 shown received within a storage and handling carton.
Figure 3:
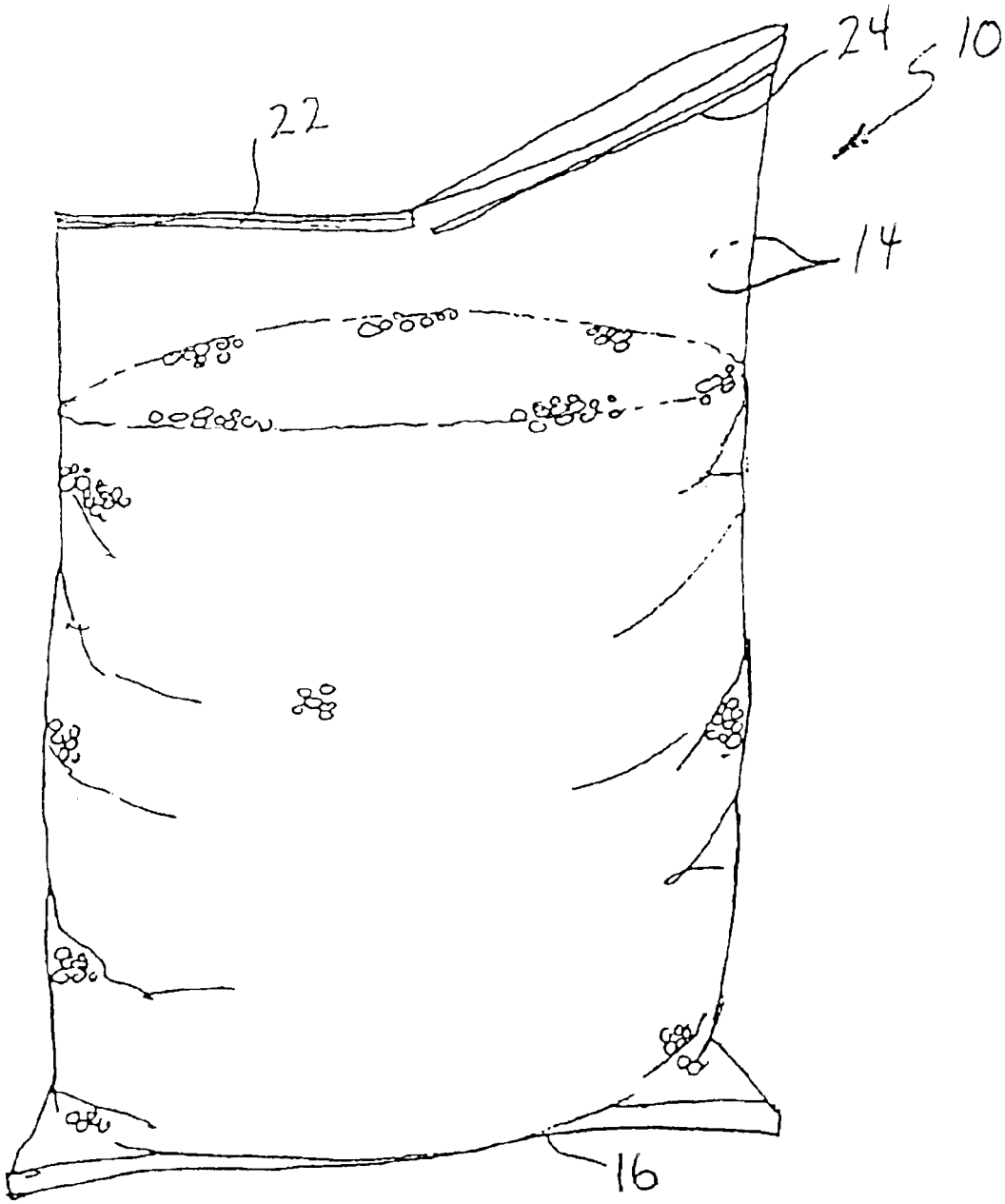
FIG. 3 is a generally schematic view of the bag of FIG. 1 after removal of the tear away upper portion to access to the removable pour spout.

A flexible bag formed with a reclosable pour spout constructed in accordance with a preferred embodiment of the present invention is designated generally by reference numeral 10 in FIGS. 1–3. The bag 10 is especially well suited for packaging pourable contents such as, for example, dry breakfast cereal. In accordance with the conventional practice for packaging breakfast cereal, the bag 10 may be used alone as the sole source of packaging (see FIGS. 1 and 3) or the bag 10 may be received within a close fitting carton or box 12 (see FIG. 2).

The bag 10 is formed from thermoplastic sheet or film material, and has overlying front and rear wall panels 14 and a closed bottom end 16. In the preferred embodiment, the closed bottom end 16 is formed as a sealed seam using conventional heat sealing means.

For purposes of example and illustration, the bag 10 is a flat tube-type bag formed of a single sheet of material which is folded over onto itself to form a joining fin seal (not shown) that runs the longitudinal length of the bag 10. However, bags incorporating the invention of this application may be fabricated in a side-gusset tube style side gusset back seam style, or any other suitable bag design.

The upper portion 26 of the bag 10 comprises a first closure region terminating in a sealed top end 18. One or more openings 19 may be provided to the sealed top end 18 to permit hanging of the bag from hooks at a retail display site. The sealed top end 18 is preferably reinforced in the area surrounding the openings 19 so that the weight of the filled bag 10 does not cause the hooks to rip through the top sealed end 18 at the openings 19.

The upper portion 26 of the bag 10 further comprises a second closure region which includes a tear strip 20 followed by an inwardly adjacent inner heat seal 22 and reclosable fastener 24. The tear strip 20 extends across the entire width of the bag 10 whereas the inner heat seal 22 only extends across a portion of the bag width having a first end located at one side of the bag 10 and a second end terminating at a distance from the opposite side of the bag 10. The reclosable fastener 24 begins where the heat seal 22 leaves off and extends across the remaining width of the bag 10 to terminate at the other side of the bag 10. As can be seen in the drawings, the inner heat seal 22 extends in the transverse direction approximately one half the width of the bag 10, although it is understood that this distance and orientation may vary.

In this embodiment, the reclosable fastener 24 is oriented along an upward oblique angle relative to the inner heat seal 22. In use, the upper portion 26 of the bag 10 is first separated from the lower portion of the bag 10 by tearing along tear strip 20 to expose the reclosable fastener (see FIG. 3).

In the case where the bag 10 is to be received within a close fitting box 12 (e.g., see FIG. 2), the height of the bag 10 is preferably designed to be taller than depth of the box 12 such that once the top of the box 12 is opened, the upwardly angled reclosable fastener 24 extends beyond the top of the box 12. In this way, the upwardly angled reclosable fastener 24 forms natural pour spout for the enclosed cereal contents. The pour spout is preferably large enough to clear any flap portions of the opened box top. The reclosable fastener 24 is preferably of the reclosable zipper type fastener that is widely used in sandwich bags and freezer bags and like food storage bags.

Referring now to FIGS. 4 to 19, various alternate embodiments of the present invention will now be described. Structural elements of the alternate embodiments common to the preferred embodiment of FIGS. 1–3 are indicated by identical reference numerals. In each of the alternate embodiments, the box 12 is shown in phantom to indicate the box 12 as an optional feature.

Figure 4:
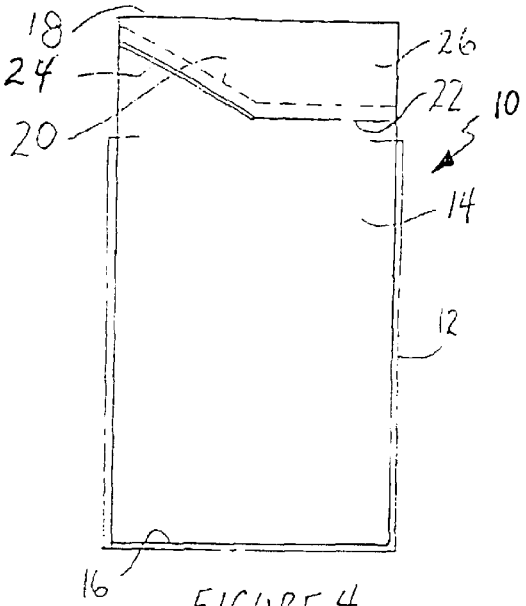
FIGS. 4 to 19 are a series of simplified schematic views similar to FIG. 1, but which illustrate various alternate embodiments of the present invention.

FIG. 4 shows a four comer bag 10 (or box liner) provided with a sealed bottom end 16 and sealed top end 18. Inner heat seal 22 is horizontally oriented across a portion of the width of the bag 10 and is spaced at distance from the sealed top end 18. The reclosable fastener 24 continue across the remaining portion of the bag 10 and is oriented along an upwardly sloping angle relative to the horizontally oriented inner heat seal 22. The bag 10 further includes a tear strip 20 disposed inwardly of (i.e., above) and closely following the profile of the inner heat seal 22 and reclosable fastener 24. In this embodiment, the reclosable fastener 24 extends approximately half way across the bag 10. It is understood, however, that the extension length of the reclosable fastener and angle of orientation may be shortened as desired to conserve on expensive zipper material This embodiment is one of the easiest designs to open, pour, reseal, and close. As before, the upper portion 26 of the bag 10 is designed to be taller than the box 12 (when the bag 10 is used as a bag liner) so that the upwardly angled reclosable fastener 24 forms a natural pour spout during use. The main difference between the embodiment of FIG. 4 and the embodiment of FIG. 1 is the absence of holes in the upper top sealed edge 18 for hanging and displaying the bag 10.

Figure 5:
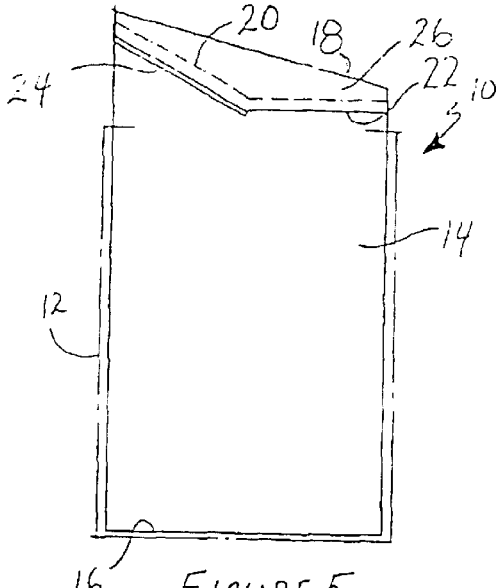

FIG. 5 shows a bag similar to that shown in FIG. 4 except that the sealed top end 18 is angled downward to roughly follow the contour of the angled reclosable fastener 24. An advantage of this design is that less bag material is required in view of the angled sealed top end 18.

Although not shown in any of the drawings, a modified version of the FIG. 5 embodiment may eliminate the tear strip 20, the reclosable fastener 24, and the inner heat seal 22, leaving only a four comer bag with an angled seal top end 18. Once opened, the angled top end of this modified version would form a natural pour spout. This is a useful feature that is not present in the prior art four corner cereal bags having a horizontal sealed top edge.

Figure 6:
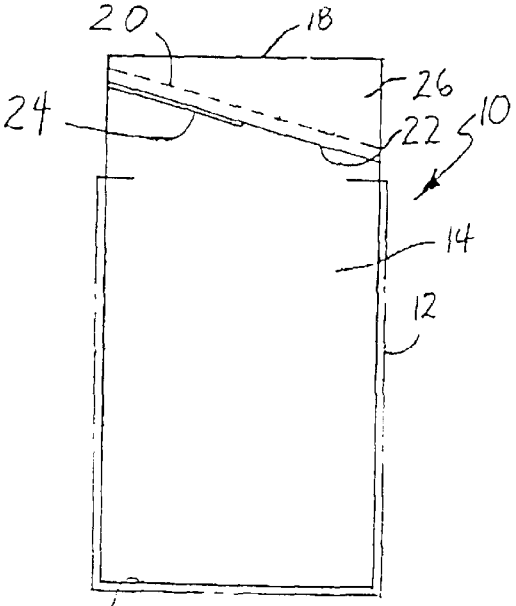

FIG. 6 shows a four comer bag 10 similar to that shown in FIG. 4 except that the inner heat seal 22 and reclosable fastener 24 are colinear and are oriented along an upwardly inclined angle as shown. The tear strip 20 is similarly angled and is positioned just above the inner heat seal 22 and reclosable fastener 24. The upwardly inclined angle of the reclosable fastener forms a natural pour spout for the bag upon removal of the tear strip 20.

Figure 7:
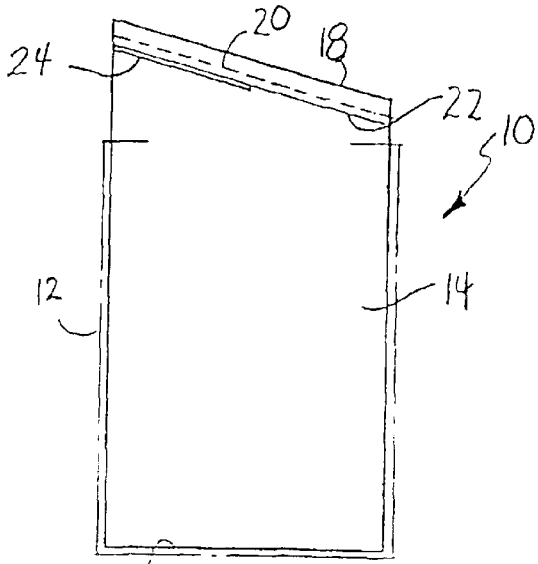

FIG. 7 shows a four corner bag 10 similar to that shown in FIG. 6 except that the sealed top end 18 is also angled to be parallel with the angle of the colinear inner heat seal 22 and reclosable fastener 24 and tear strip 20. The embodiment of FIG. 7 has less bag material as compared to the four corner bag designs with a horizontal top sealed end.

Figure 8:
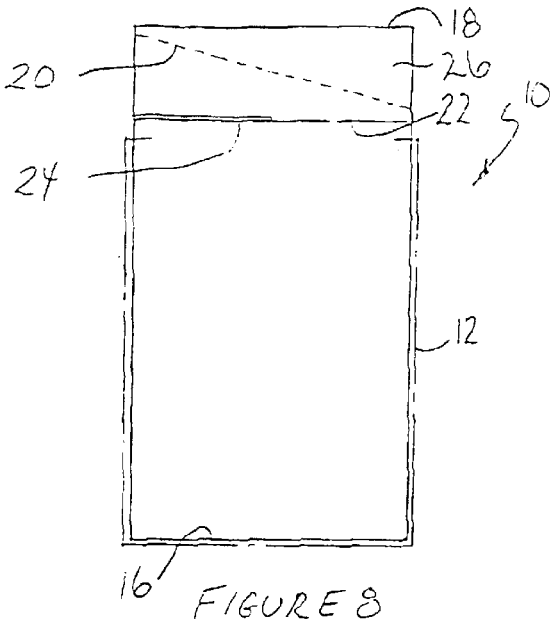

FIG. 8 shows a four corner bag 10 having a horizonal sealed top end 18 with a inner heat seal 22 and reclosable fastener 24 oriented along line parallel to the sealed top end 18 and spaced a distance inwardly therefrom. The tear strip 20 is positioned between the sealed top end 18 and the colinear inner heat seal 22 and reclosable fastener 24 and is oriented at an upward angle so as to form a pour spout above the reclosable fastener 24.

Figure 9:
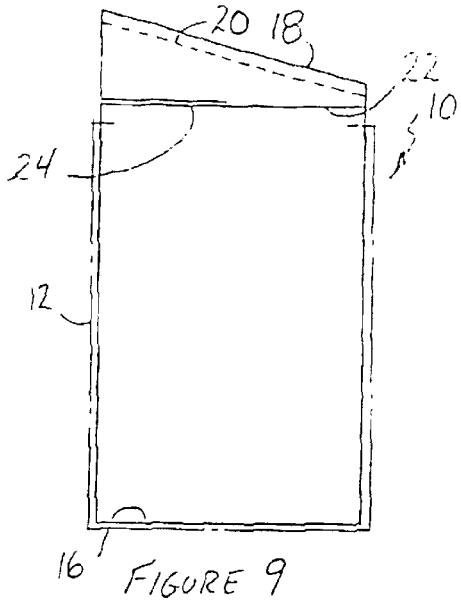

FIG. 9 shows a four corner bag 10 similar to that shown in FIG. 8 except that the sealed top end is also angled to be parallel with the angle of the upwardly inclined tear strip 20.

Figure 10A:
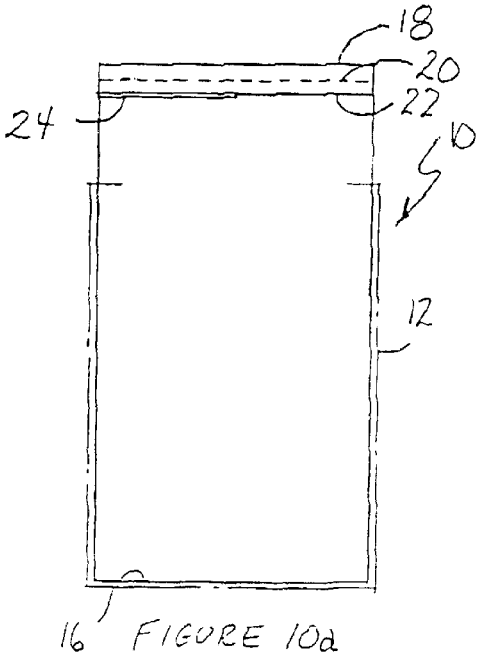

FIG. 10*a* shows a four corner bag 10 having a horizonal sealed top end 18 with an inner heat seal 22 and reclosable fastener 24 both of which are oriented along line parallel to and spaced in close proximity with the sealed top end 18. The tear strip 20 is positioned between the sealed top end 18 and the colinear inner heat seal 22 and reclosable fastener 24.

Figure 10B:
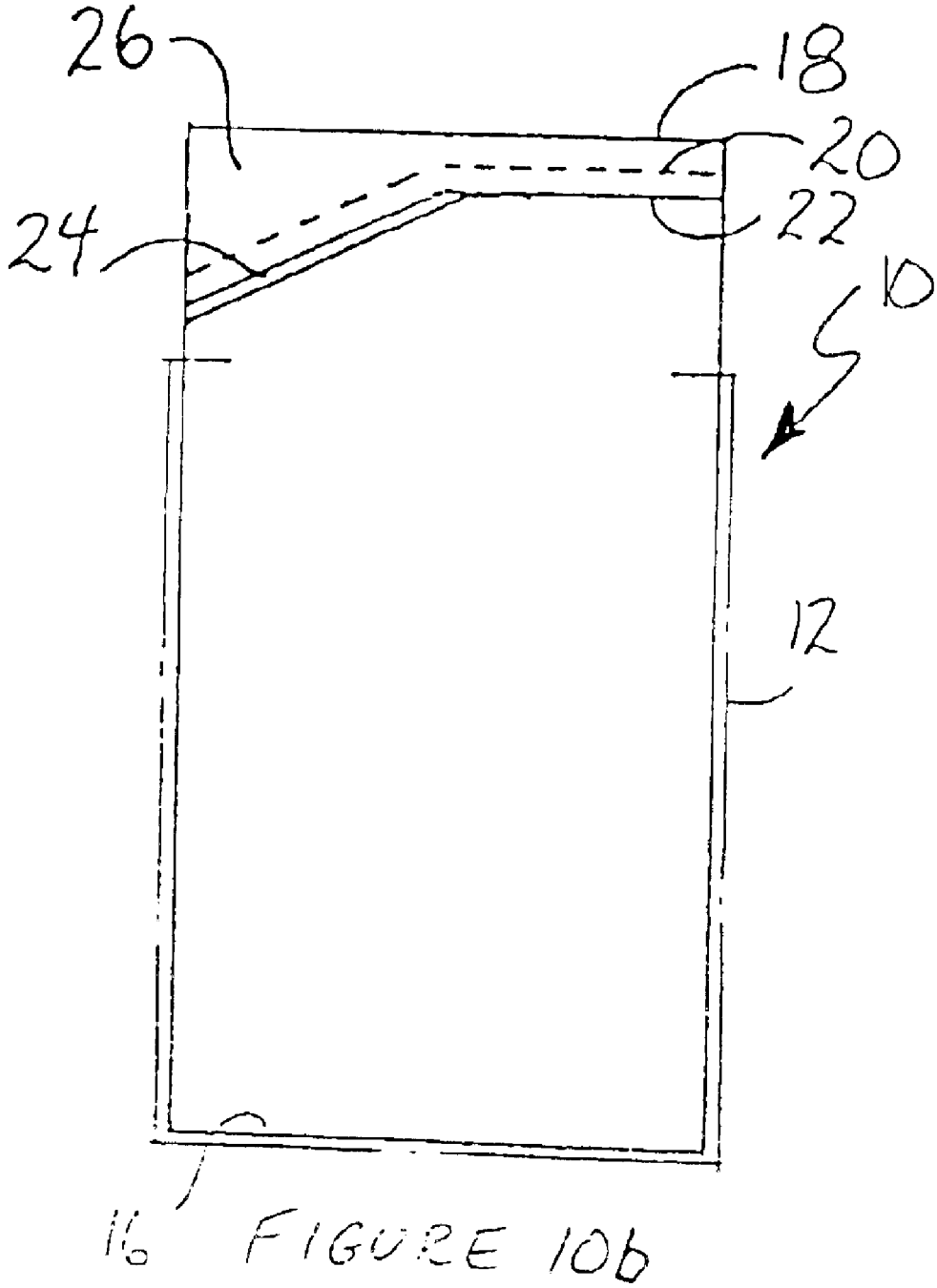

FIG. 10*b* shows a four comer bag 10 having a horizonal sealed top end 18 with an inner heat seal 22 oriented transversely across a portion of the bag and spaced in close proximity with the sealed top end 18. Reclosable fastener 24 spans the remaining width portion of the bag 10 and is oriented at a downward sloping angle relative to the horizontally oriented inner heat seal 22 so as to form a natural pour spout upon opening of the bag. The tear strip 20 is positioned inwardly of the sealed top end 18 and follows both the horizontal path of the inner heat seal 22 and the downward slope of the reclosable fastener 24.

Figure 11:
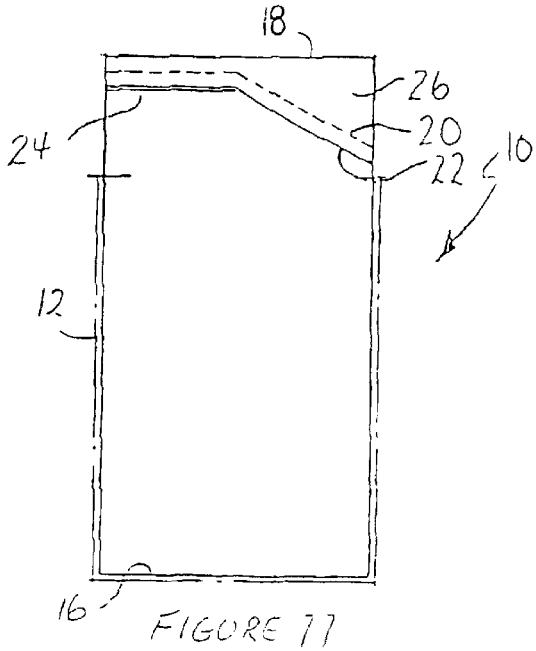

FIG. 11 show a four comer bag 10 similar to that show in FIG. 10 except that the inner heat seal 22 is downwardly angled with respect to the reclosable fastener 24. The profile of the tear strip 20 closely follows the horizontal orientation of the reclosable fastener 24 and the downwardly sloping orientation of the inner heat seal 22.

Turning now to FIGS. 12 to 19, various other embodiments of the invention which do not have an inner heat seal disposed inwardly of a reclosable fastener will be described.

Figure 12:
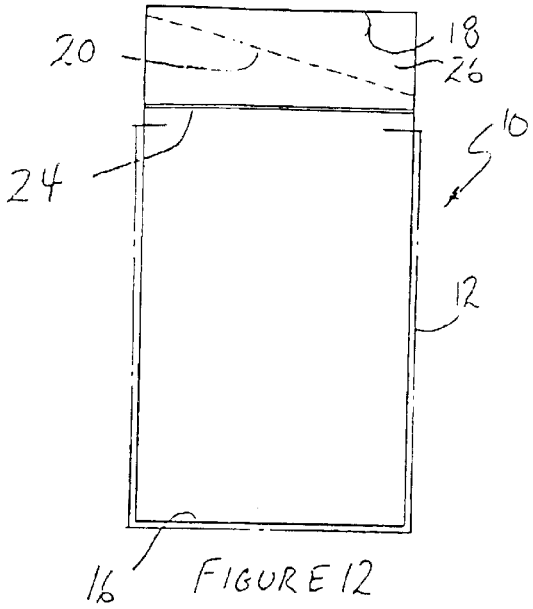

FIG. 12 shows a four corner bag 10 having a horizonal sealed top end 18 with a full reclosable fastener 24 that extends transversely or horizontally across the width of the bag 10 and is spaced at a distance inwardly from the sealed top end 18. The tear strip 20 is positioned between the sealed top end 18 and the reclosable fastener 24 and is oriented at an upward angle so as to form a pour spout above the reclosable fastener 24.

Figure 13:
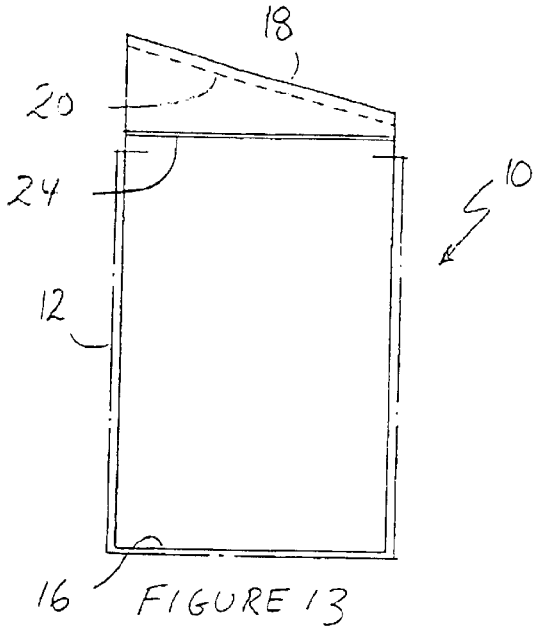

FIG. 13 shows a four corner bag 10 similar to that shown in FIG. 12 except that the sealed top end 18 is also angled along a downward slope to be parallel with the angle of the tear strip 20.

Figure 14:
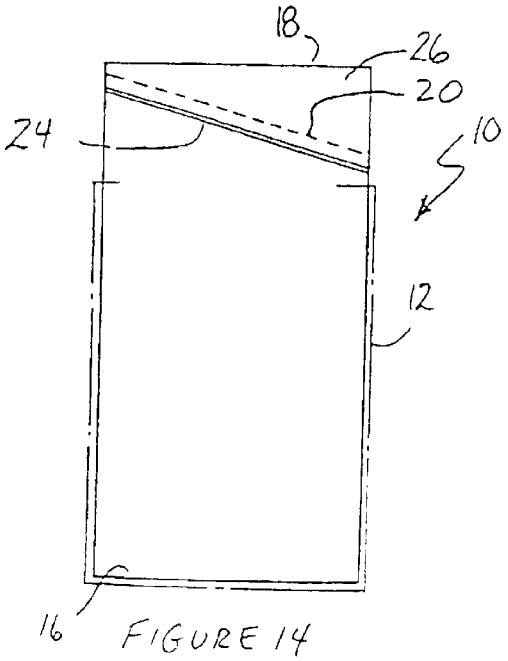

FIG. 14 shows a four corner bag 10 having a horizonal sealed top end 18 similar to FIG. 12 except that the full width reclosable fastener 24 extends along an upwardly sloping angle across the width of the bag 10.

The reclosable fastener 24 is oriented at the upward angle is configured with a first end of said reclosable fastener disposed at a first side of said bag at a high location (relative to the bottom 16 of the bag) and a second end of the redosable fastener being disposed at a position on said bag which is located a distance down (the spaced distance inward and toward the bottom 16 of the bag) and transverse from the high location at the first side of said bag. In the embodiment shown the transverse distance is the full width of the bag (from the first side to a second side). The tear strip 20 is located just above the reclosable fastener 24.

Figure 15:
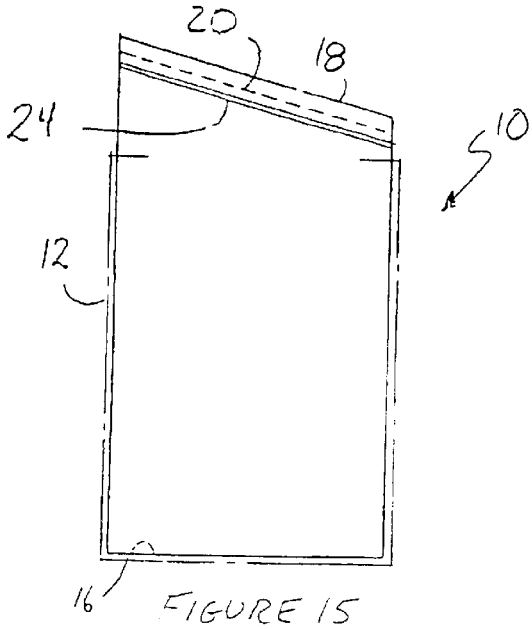

FIG. 15 shows a four corner bag 10 similar to that shown in FIG. 14 except that the sealed top end 18 is also angled along a downward slope to be parallel with the angle of the tear strip 20 and full width reclosable fastener 24.

Figure 16:
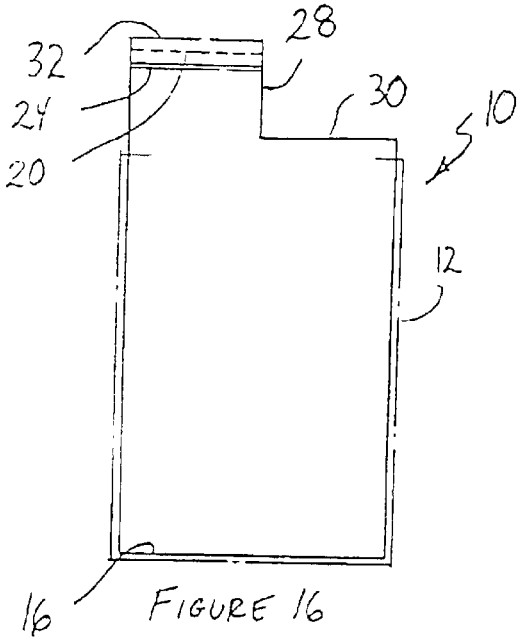

FIG. 16 shows a six corner bag 10 of generally L shape configuration with an upper corner extension that is approximately one half the width of the bag 10. Sealed edges 28, 30, and 32 form the upper closed boundary of the bag 10. As is the case with the sealed seams disclosed in the above-described embodiments, the sealed edges 28, 30 and 32 are formed using conventional sealing means. Horizontally oriented reclosable fastener 24 is disposed in close proximity with the uppermost sealed edge 32 and is separated therefrom by an intermediate tear strip 24.

Figure 17:
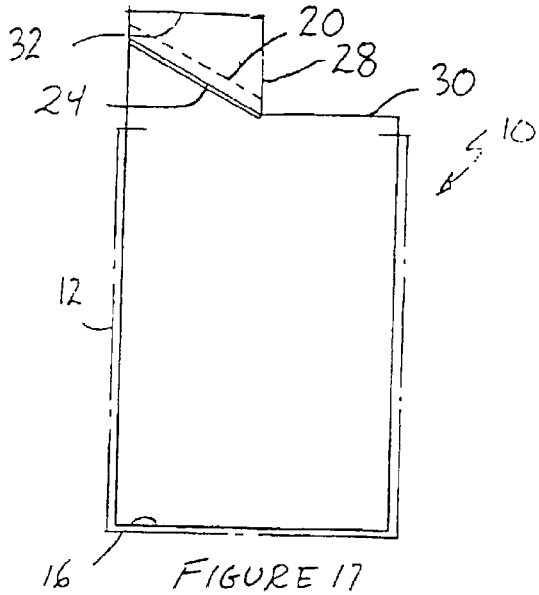

FIG. 17 shows a six corner bag 10 similar to that shown in FIG. 16 except that reclosable fastener 24 and tear strip 22 are upwardly angled relative to the transversely oriented sealed edge 30. This design is similar to that shown in FIG. 4.

Figure 18:
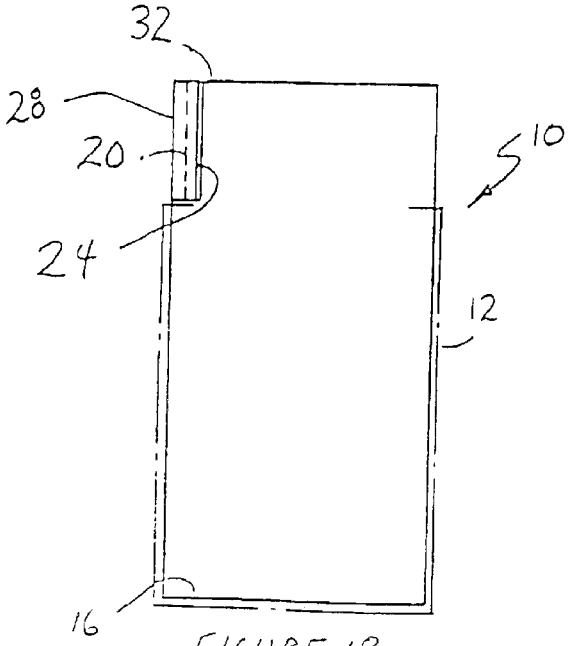

FIG. 18 shows a four corner bag 10 having an uppermost sealed edge 32 and a vertically oriented reclosable fastener 24 disposed at an upper comer region of the bag 10.

As shown in FIG. 18, the vertical sides of bag 10 are about 2.25 times the length of top 32 edge and bottom edge 16 witch are also shown parallel to each other. Reclosable fastener 24 is located at the upper end of the left side in FIG. 18 with one end coupled to an end of top edge 32 and a second end coupled to the seam of the left side about a quarter of the length a side down from top edge 32. Additionally, when the top of bag 10 is withdrawn from the top of box 12, the entire length of reclosable fastener 24 is shown extending above the top edge of box 12. A tear strip 20, followed by vertically oriented sealed edge 28, are located outwardly of the vertically oriented reclosable fastener 24.

Figure 19:
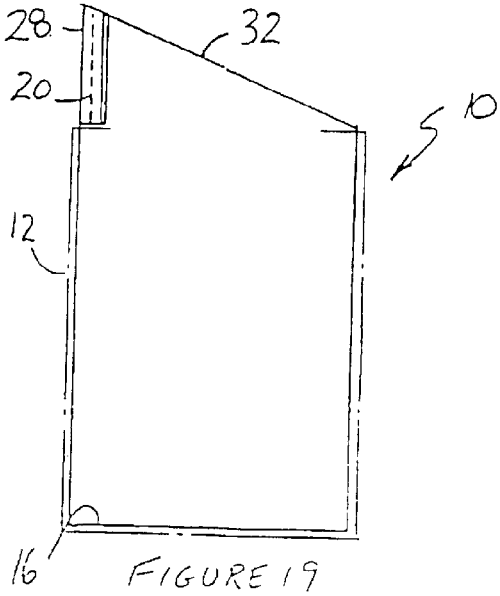

FIG. 19 shows a four comer bag 10 similar to that shown in FIG. 18 except that the uppermost sealed edge 32 is angled along a downward slope to conserve bag material.

In this view, redosable fastener 24 is shown at the top of the longer of the two sides. As shown here with the top of bag 10 withdrawn from box 12, the entire length of reclosable fastener 24 extends above the top edge of box 12 with top edge 32 sloping downward to a point on the opposite edge that is approximately even with the top edge of box 12.

Figure 20:
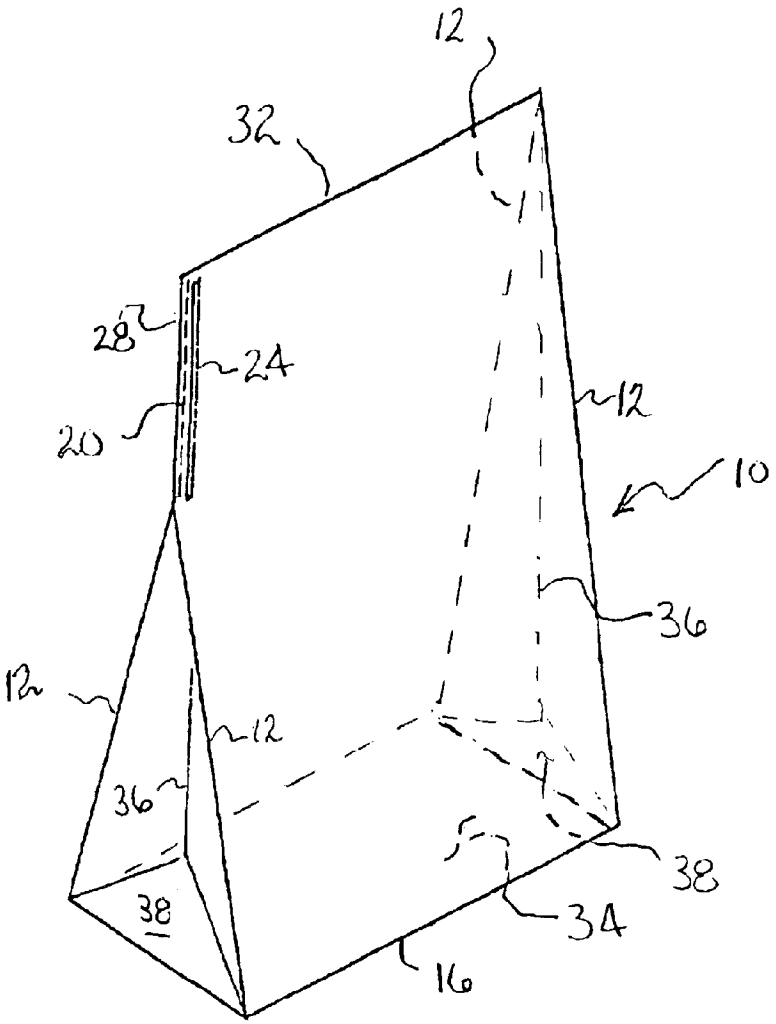
FIGS. 20 and 21 are perspective views of a side gusset bag implementation of the bags shown in FIGS. 18 and 19.
Figure 21:
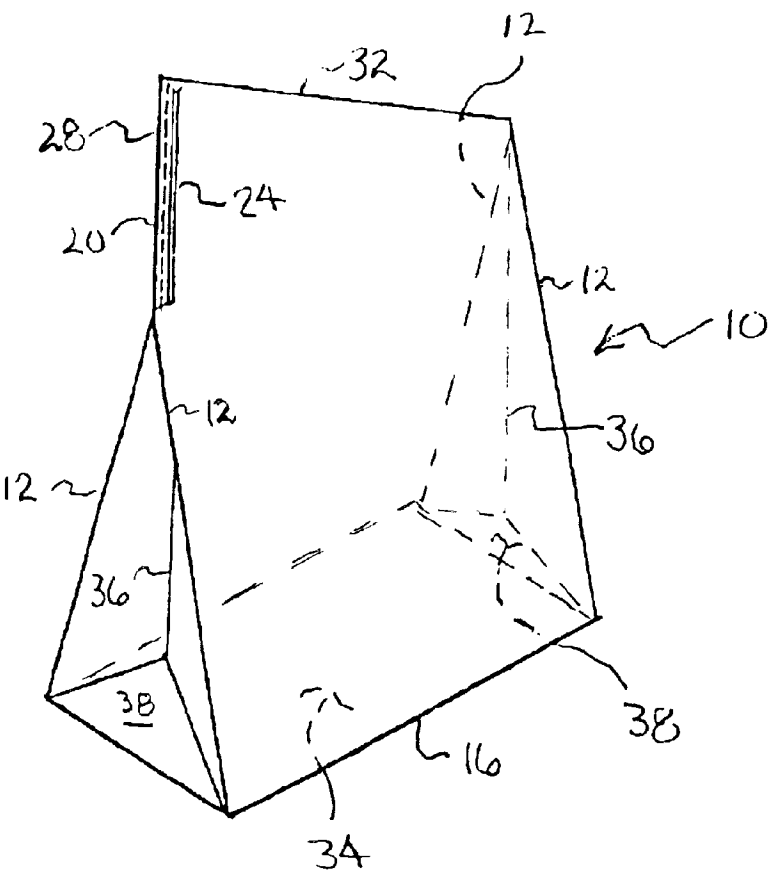

FIGS. 20 and 21 illustrate, in perspective, a side gusset bag implementation of the bags of FIGS. 18 and 19, respectively. In FIG. 20, top edge 32 is parallel to edge 16 and in FIG. 21 top edge 32 is sloped with respect to bottom edge 16 with an included acute angle between edges 28 and 32 and an obtuse included angle between edges 12 and 32 at the right end in FIG. 21. In addition to the front and back panels which are as shown in FIGS. 18 and 19, FIGS. 20 and 21 show a typical side gusset configuration with a typical bottom 34 and typical two side gussets of a typical side gusset bag with the front and back edges of bottom 34 sealed to the bottom edge 16 of the front and back panels of the bag. Each of the side gussets in each of FIGS. 20 and 21 extends from, and is sealed to, bottom 34 between side edges 12 of the front and back panels of the bag to which they are also sealed. The bags of FIGS. 20 and 21 can be formed either from a tube of plastic material, or from one to five sheets of plastic material.

Each of the side gussets includes a typical center fold 36 and lower triangular region 38 formed by the folds of each side gusset in the typical way with triangle region having a height that is one half the length of a side edge of bottom 34. On the left side of each of the views in FIGS. 20 and 21, the side gusset extends from bottom 34, between bottom edges 16, to the lower end of the closed edges of the front and back panels with those closed edges extending to the top sealed edge 32 incorporating tear strip 20 and reclosable fastener 24 of FIGS. 18 and 19. On the right side of each of the views in FIGS. 20 and 21, the side gusset extends from bottom 34, between bottom edges 16, top sealed edge 32.

In the embodiment of FIGS. 18 and 19, the reclosable fastener is vertically or longitudinally oriented and disposed adjacent a side edge at an upper corner region of the bag. Additionally, in FIG. 18 all four corners of bag 10 are shown as having an included right angle. In FIG. 19, however, the two corners at the bottom of the bag are shown as having an included right angle, the upper corner between side 12 and the top of the bag is shown as having an included acute (less than 90°) angle, and the other upper corner of the bag is shown as having an included obtuse (greater than 90°) angle.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A flexible bag for packaging pourable contents such as dry cereal, the bag being formed of sheet material and comprising:

front and back wall panels each having a rectilinearly shaped surface and top, bottom, and first and second side edges, for each of said wall panels said top and bottom edges are parallel to, and the same length as, each other; and the top and bottom edges are longer than the first and second side edges;

a first gusseted side panel having a bottom edge, and first and second side edges with a length of said first and second side edges of said first gusseted side panel and said first edges of said back and front wall panels being the same length;

a second gusseted side panel having a bottom edge, and first and second side edges with a length of said first and second side edges of said second gusseted side panel being at least two thirds the length of said second edges of said back and front wall panels; and a bottom panel having a rectilinearly shaped surface with front, back, and first and second side edges, said front and back edges being opposite each other and said first and second side edges being opposite each other; said front and back edges being the same length as said bottom edges of said front and back wall panels; and said first and second side edges being the same length as said bottom edge of said first and second gusseted side panels, respectively; and wherein said front and back edges of said bottom panel and said bottom edges of said front and back wall panels are sealed together, respectively; said first and second side edges of said bottom panel and said bottom edges of said first and second gusseted side panels are sealed together, respectively; said first side edge of each of said front and back wall panels and said first and second side edges of said first gusseted side panel are sealed together, respectively; said top edges of said front and back wall panels are sealed together; and said first and second side edges of said second gusseted side panel, beginning at the bottom edge of said second gusseted side panel, are sealed to said second side edges of said front and back wall panels, respectively, forming a pouch between interior surfaces of each of said front and back wall panels, said bottom panel and each of said first and second gusseted side panels with an opening defined along the second side edges of said front and back wall panels extending between the top edges of the front and back wall panels and a top point of said second gusseted side panel.

2. The bag according to claim 1:

further comprising a reclosable closure inserted into the opening, said reclosable closure sealed to an inner surface of each of said front and back wall panels and the top edges of said front, back and second gusseted side panel adjacent said opening; and wherein when said closure is closed said pouch of the bag closed and when said closure is open any contents within the pouch are pourable from the bag.

3. The bag according to claim 2 wherein said second side edges of said front and back wall panels further include a tear strip adjacent said opening of the bag so that removal of said tear strip allows access to said reclosable closure, and opening said reclosable closure forms a pour spout permitting contents contained within the bag to be poured therefrom.

4. The bag according to claim 2 wherein said reclosable closure is disposed inwardly relative to the second edges of said first and second wall panels of said bag.

5. The bag according to claim 1 wherein said second side edges of said front and back wall panels further include a tear strip adjacent said opening of the bag so that removal of said tear strip allows access to the bag and said opening forms a pour spout permitting contents contained within the bag to be poured therefrom.

6. The bag according to claim 5:

further comprising a reclosable closure inside said tear strip and inserted into the opening defined along said second side edges of said front and back wall panels between said top edges of said front, back and second gusseted side panels, said reclosable closure sealed to an inner surface of each of said front and back wall panels and the top edges of said front, back and second gusseted side panel adjacent said opening; and wherein when said closure is closed said pouch of the bag is closed and when said closure is open any contents within the pouch are pourable from the bag.

7. The bag according to claim 6 wherein said reclosable closure is disposed inwardly relative to the second edges of said first and second wall panels of said bag.

8. The bag according to claim 1 wherein said first and second gusseted side panels include fold lines that define a center line between said first and second side edges extending downward from said top edge; a triangle extending upward from said bottom edge having a highest point from said bottom edge centered between said first and second side edges with a height from the bottom edge being one half a length of said bottom edge; and said center line meeting said highest point of said triangle.

9. A flexible bag for packaging pourable contents such as dry cereal, the bag being formed of sheet material and comprising:

front and back wall panels each having a polygonally shaped surface and top, bottom, and first and second side edges, for each of said wall panels said first and second side edges are parallel to each other with said second side edge being longer than said first side edge; said bottom edge is perpendicular to one end of each of said first and second side edges; said top edge intersects another end of each of said first and second side edges with an included angle other than 90°; said top edge is longer than said bottom edge; and each of said first and second side edges is longer than each of the top and bottom edges;

a first gusseted side panel having a bottom edge, and first and second side edges with a length of said first and second side edges of said first gusseted side panel and said first edges of said back and front wall panels being the same length;

a second gusseted side having a bottom edge, and first and second side edges with a length of said first and second side edges of said second gusseted side panel being at least two thirds the length of said second edges of said back and front wall panels; and a bottom panel having a rectilinearly shaped surface with front, back, and first and second side edges, said front and back edges being opposite each other and said first and second side edges being opposite each other; said front and back edges being the same length as said bottom edges of said front and back wall panels; and said first and second side edges being the same length as said bottom edges of said first and second gusseted side panels, respectively; and wherein said front and back edges of said bottom panel and said bottom edges of said front and back wall panels are sealed together, respectively; said first and second side edges of said bottom panel and said bottom edges of said first and second gusseted side panels are sealed together, respectively; said first side edge of each of said front and back wall panels and said first and second side edges of said first gusseted side panel are sealed together, respectively; said top edges of said front and back wall panels are sealed together; and said first and second side edges of said second gusseted side panel, beginning at the bottom edge of said second gusseted side panel, are sealed to said second side edges of said front and back wall panels, respectively, forming a pouch between interior surfaces of each of said front and back wall panels, said bottom panel and each of said first and second gusseted side panels with an opening defined along the second side edges of said front and back wall panels extending between the top edges of the front and back wall panels and a top point of said second gusseted side panel.

10. The bag according to claim 9:

further comprising a reclosable closure inserted into the opening, said reclosable closure sealed to an inner surface of each of said front and back wall panels and the top edges of said front, back and second gusseted side panels adjacent said opening; and wherein when said closure is closed said pouch of the bag is closed and when said closure is open any contents within the pouch are pourable from the bag.

11. The bag according to claim 10 wherein said second side edges of said front and back wall panels further include a tear strip adjacent said opening of the bag so that removal of said tear strip allows access to said reclosable closure, and opening said reclosable closure forms a pour spout permitting contents contained within the bag to be poured therefrom.

12. The bag of claim 10 wherein said reclosable closure is disposed inwardly relative to the second side edges of said front and back wall panels of said bag.

13. The bag of claim 9 wherein said second side edges of said front and back wall panels further include a tear strip adjacent said opening of the bag so that removal of said tear strip allows access to the bag and said opening forms a pour spout permitting contents contained within the bag to be poured therefrom.

14. The bag of claim 13:

further comprising a reclosable closure inside said tear strip and inserted into the opening, said reclosable closure sealed to an inner surface of each of said front and back wall panels and the top edges of said front, back and second gusseted side panels adjacent said opening; and wherein when said closure is closed said pouch of the bag is closed and when said closure is open any contents within the pouch are pourable from the bag.

15. The bag according to claim 14 wherein said reclosable closure within said tear strip is disposed inwardly relative to the second edges of said first and second wall panels of said bag.

16. The bag according to claim 9 wherein said first and second gusseted side panels include fold lines that define a center line between said first and second side edges extending downward from said top edge; a triangle extending upward from said bottom edge having a highest point from said bottom edge centered between said first and second side edges with a height from the bottom edge being one half a length of said bottom edge; and said center line meeting said highest point of said triangle.

* * * * *

UNITED STATES PATENT AND TRADEMARK OFFICE

CERTIFICATE OF CORRECTION

PATENT NO. : 6,857,779 B2
DATED : February 22, 2005
INVENTOR(S) : Alan D. Olin

It is certified that error appears in the above-identified patent and that said Letters Patent is hereby corrected as shown below:

Column 8,
Line 48, reads "each other; and the top and bottom edges are longer" should read
-- each other; and the top and bottom edges are shorter --

Signed and Sealed this

Nineteenth Day of July, 2005

JON W. DUDAS
*Director of the United States Patent and Trademark Office*